US006070820A

United States Patent [19]

Young et al.

[11] Patent Number: 6,070,820

[45] Date of Patent: Jun. 6, 2000

[54] TABLE REINFORCING RING FOR A VERTICAL SHAFT IMPACT CRUSHER

[75] Inventors: Gregory A. Young, Cedar Rapids; Michael P. Stemper, Marion, both of Iowa

[73] Assignee: Cedarapids, Inc., Cedar Rapids, Iowa

[21] Appl. No.: 09/273,587

[22] Filed: Mar. 22, 1999

[51] Int. Cl.[7] ..... B02C 19/00

[52] U.S. Cl. ..... 241/275; 241/291; 241/300

[58] Field of Search ..... 241/275, 291, 241/300, 188.1, 274

[56] References Cited

U.S. PATENT DOCUMENTS

| | | | |
|---|---|---|---|
| 4,090,673 | 5/1978 | Ackers et al. | 241/275 |
| 5,323,974 | 6/1994 | Watajima | 241/275 |
| 5,497,951 | 3/1996 | Watajima | 241/300 |
| 5,639,030 | 6/1997 | Watajima et al. | 241/30 |

*Primary Examiner*—John M. Husar
*Attorney, Agent, or Firm*—Marshall, O'Toole, Gerstein, Murray & Borun

[57] ABSTRACT

On a vertical shaft impact crusher, a table assembly having a reinforcing ring is disclosed. The vertical shaft impact crusher for crushing aggregate material includes a frame, with the table assembly being mountable to the frame for rotation about a vertical axis. The crusher includes a housing defining an impact surface spaced about an interior of the housing and surrounding the table assembly. The table assembly comprises a top surface, a bottom surface, and a peripheral edge. The top surface includes a central portion defining an aggregate landing surface, with the central portion being adapted to permit outward migration of the aggregate material in response to rotation of the table assembly. A plurality of shoe assemblies are mounted to the top surface adjacent to and spaced along the peripheral edge, with each shoe assembly being adapted to cause the outwardly migrating aggregate material to be thrown against the housing impact surface in response to rotation of the table assembly. The shoe assemblies collectively imparting a downward bending moment to the table assembly in response to rotation of the table assembly. A reinforcing ring is mounted to the table assembly bottom surface, with the reinforcing ring being responsive to rotation of the table assembly to thereby counteract the downward bending moment, whereby the stresses on the table assembly are relieved.

24 Claims, 5 Drawing Sheets

TABLE REINFORCING RING FOR A VERTICAL SHAFT IMPACT CRUSHER

FIELD OF THE INVENTION

The present invention relates to rock crushing apparatus, and more particularly to vertical shaft impact crushers.

BACKGROUND OF THE INVENTION

Vertical shaft impact crushers are generally known in which centrifugal force is used to hurl large rocks against an impact surface, thereby to obtain smaller crushed rocks. Rock material is typically fed into a rotating impeller which hurls the rock material against a plurality of anvils disposed about the impeller. In the alternative, the rotating impeller throws the rock material against a bed of already crushed rock instead of the anvils. In either event, the rock crusher processes relatively larger rock material into relatively smaller crushed rock.

One important consideration in the design of rock crushers is the extension of the useful life span of the equipment. It will be appreciated that certain of the components come into direct contact with the rock material and, therefore, are subject to wear. Accordingly, the wear components are typically releasably attached to the rock crushing apparatus so that they may be removed and replaced. Other components are intended to be permanent, and therefore must be protected from direct contact with the rock material. The non-wear components are usually more permanently attached to the crusher apparatus.

For example, in a vertical shaft impact crusher of the "open table" type, the rotating impeller comprises a generally flat table having multiple shoe assemblies projecting from a top surface of the table near its periphery. The shoe assemblies typically comprise a support bracket attached to the table and a shoe releasably secured to the bracket. Rock material is dropped near the center of the table and, under centrifugal force, moves toward the periphery of the table where the shoes direct the large rock material toward an impact surface surrounding the table assembly, typically an anvil ring. The table is mounted on a flywheel attached to a rotating shaft. In this example, the shoes and anvil ring contact the rock material and therefore are wear components which should be attached to the crusher apparatus in such a manner that they are easily removed and replaced. The table, flywheel, and shaft are shielded from direct impact and therefore are more permanent, non-wear components.

The table of the above-described rock crusher experiences significant stress during operation. The shoes are mounted near the periphery of the table and therefore create a bending moment in the table. An additional downward bending moment is created when the table rotates due to centrifugal forces acting on the shoes projecting from the top surface of the table. Additionally, the impact forces of the aggregate material against each shoe creates a bending stress in the table about a radial axis extending from the table center to the shoe.

It is often desirable for a crusher to be capable of crushing increasingly larger incoming rock material. In this event, conventional rock crushers often use a larger table to increase the speed at which rock material is thrown at the impact surface, thereby to more effectively break the rock material. The larger table, however, requires a corresponding size increase in many of the other components in the crushing apparatus, and therefore is not suitable for retro-fit installation.

One approach to improving the performance of the crusher while maintaining the overall size of the apparatus is to increase the rotational speed of the table. While the increased rotational speed increases the speed of the rock material striking the impact surface, the stresses in the table increase. Thus, there is an increased chance of table failure caused by the high resulting stresses.

The stress in the table is further affected by the load carried by the table. For example, the shoes may be attached to the table using threaded fasteners rather than pins. The threaded fasteners require mounting brackets which mate with the removable shoes. The mounting brackets for the threaded connection, however, have a significantly higher mass than the pin-type shoe brackets, and therefore the load carried at the periphery of the table is increased.

The risk of table failure is often greatest when a table of a vertical shaft impact crusher is retrofitted to operate at a higher rotational speed or with heavier, fastener-type shoes and brackets. In such a procedure, the table is not typically replaced since it is a non-wear member. Accordingly, the table is subjected to higher stresses than originally intended, and therefore the likelihood of failure is increased.

SUMMARY OF THE INVENTION

In accordance with certain aspects of the present invention, a table assembly is provided for a vertical shaft impact crusher for crushing aggregate material. The crusher has a frame, and the table assembly is mountable to the frame for rotation about a vertical axis. The crusher further includes a housing defining an impact surface spaced about an interior of the housing and surrounding the table assembly. The table assembly comprises a top surface, a bottom surface, and a peripheral edge, the top surface including a central portion defining an aggregate landing surface. The central portion is adapted to permit outward migration of the aggregate material in response to rotation of the table assembly. A plurality of shoe assemblies are mounted to the top surface adjacent to and spaced along the peripheral edge, each of the shoe assemblies being adapted to cause the outwardly migrating aggregate material to be thrown against the housing impact surface in response to rotation of the table assembly. The shoe assemblies collectively impart a downward bending moment to the table assembly in response to rotation of the table assembly. A reinforcing ring is mounted to the table assembly bottom surface and is responsive to rotation of the table assembly to thereby resist the downward bending moment, thereby to redistribute the stresses on the table assembly.

In accordance with additional aspects of the present invention, the reinforcing ring includes a circumferential notch adapted to accept a flange of a protective liner.

According to other aspects of the present invention, a table is provided for a vertical shaft impact crusher for crushing aggregate material. The crusher has a frame and the table is mountable to the frame for rotation about a vertical axis. The crusher further has a drive system and a housing defining an impact surface spaced about an interior of the housing and surrounding the table. The table comprises an upper portion, a lower portion, and a peripheral edge portion. A driven gear is mounted to the table lower portion and operatively coupled to the drive system. The upper portion includes a central portion adapted to receive the aggregate material, the central portion being adapted to permit outward migration of the aggregate material in response to rotation of the table assembly. A plurality of impact shoes are mounted to the upper portion and spaced outwardly from the central portion, each impact shoe being adapted to contact a portion of the outwardly migrating aggregate material to thereby throw the portion of aggregate material against the housing impact surface in response to rotation of the table. The plurality of impact shoes collectively impart bending stresses to the table in response to rotation of the table. A reinforcing ring is mounted to the table assembly bottom surface and is responsive to rotation of the table assembly to thereby resist the bending stresses.

In accordance with further aspects of the present invention, a vertical shaft impact crusher is provided for crushing rock material. The crusher has a housing, an impact surface located about an interior periphery of the housing, a table assembly supported for rotation about an axis, the table assembly including a table having a central landing surface, and a shoe assembly attached to an upper surface of the table and having a guide surface defining a throw path for the rock material. A reinforcing ring depends from a lower surface of the table.

DESCRIPTION OF THE PREFERRED EMBODIMENTS

Figure 1:
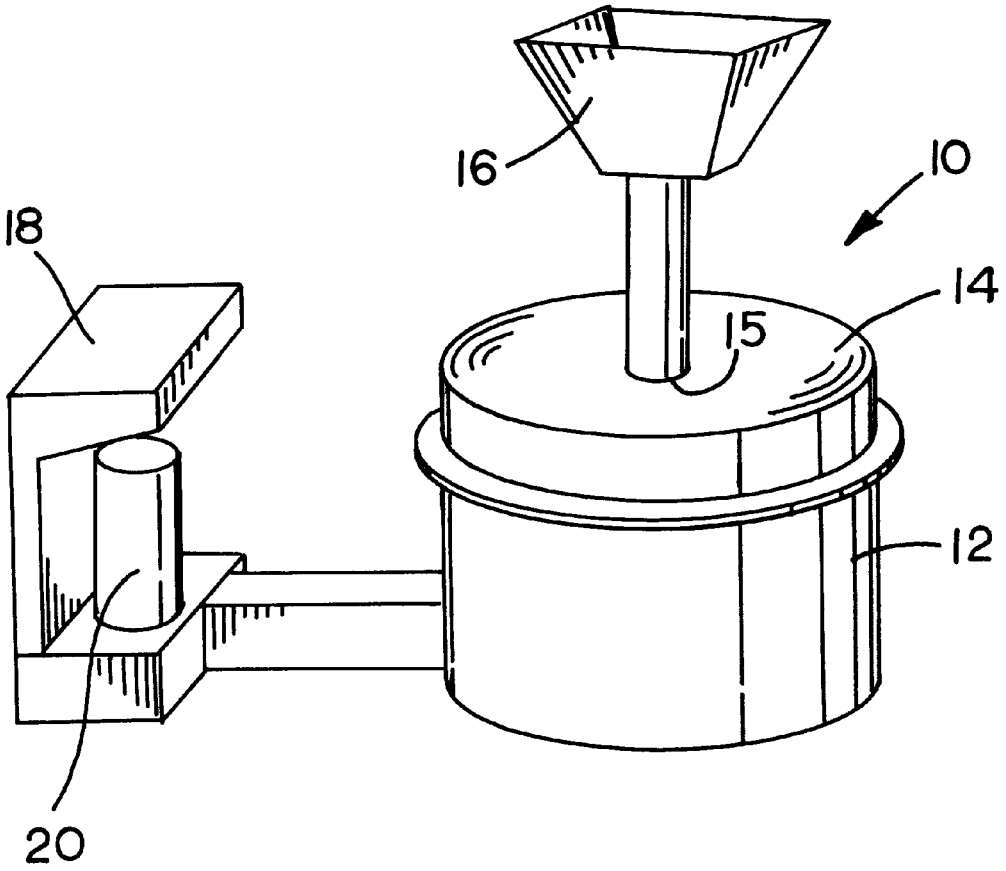
FIG. 1 is a schematic view in perspective of a vertical shaft impact crusher in accordance with the present invention.
Figure 2:
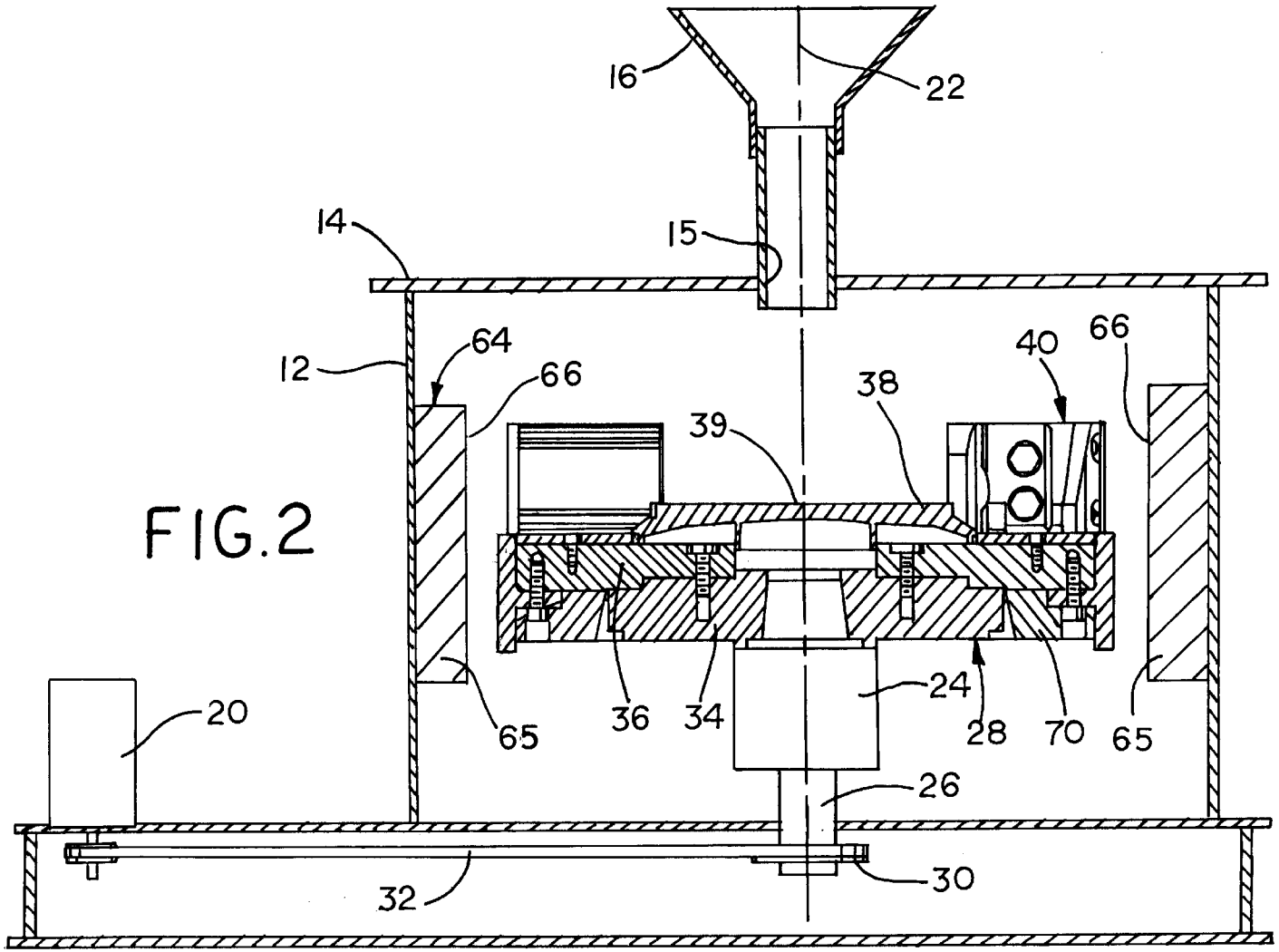
FIG. 2 is a side elevation view, in section, of the vertical shaft impact crusher of FIG. 1 having installed therein a table assembly constructed in accordance with the teachings of the present invention.

Referring initially to FIG. 1, a vertical shaft impact crusher of the present invention, indicated generally at 10, has a housing 12 with a housing cover 14 attached thereto. The housing cover 14 defines a feed opening 15, and a hopper 16 is attached to the housing cover 14 at the feed opening 15. A separate motor housing 18 is spaced from the housing 12 and houses a motor 20. As best illustrated in FIGS. 1 and 2, the housing 12 is generally cylindrical and has a central axis 22 extending vertically. A bearing assembly 24 is locating inside the housing 12, the bearing assembly rotatably journaling a shaft 26 having a table assembly 28 attached to its upper end. The lower end of the shaft 26 carries a pulley 30 which is driven by the motor 20 through a belt 32.

The table assembly 28 comprises a flywheel 34, a table 36, and a table cover 38. According to the illustrated embodiment, the table 36 is bolted to the flywheel 34 while the table cover 38 is attached to an upper surface of the table 36. A center portion of the table cover 38 provides a landing surface 39 onto which rock material entering the crusher 10 is deposited. The flywheel 34 engages the shaft 26 so that the entire table assembly 28 rotates with the shaft.

Figure 3:
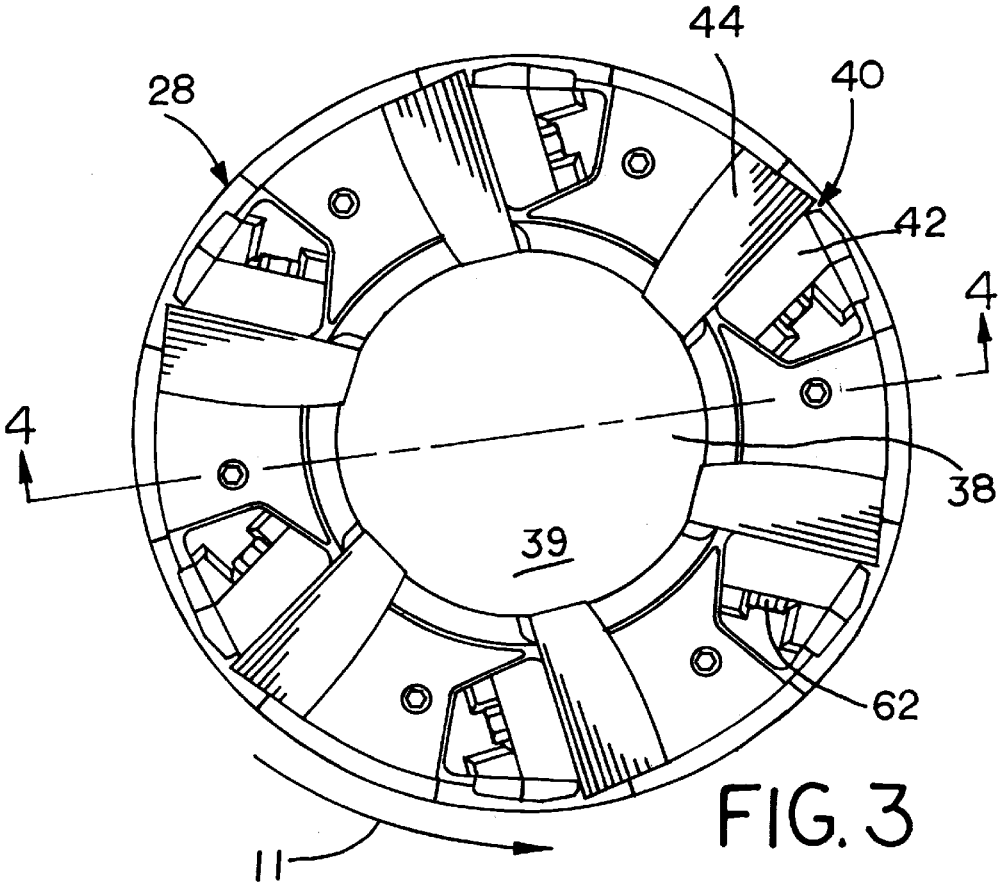
FIG. 3 is a top plan view of the table assembly of the present invention.
Figure 5:
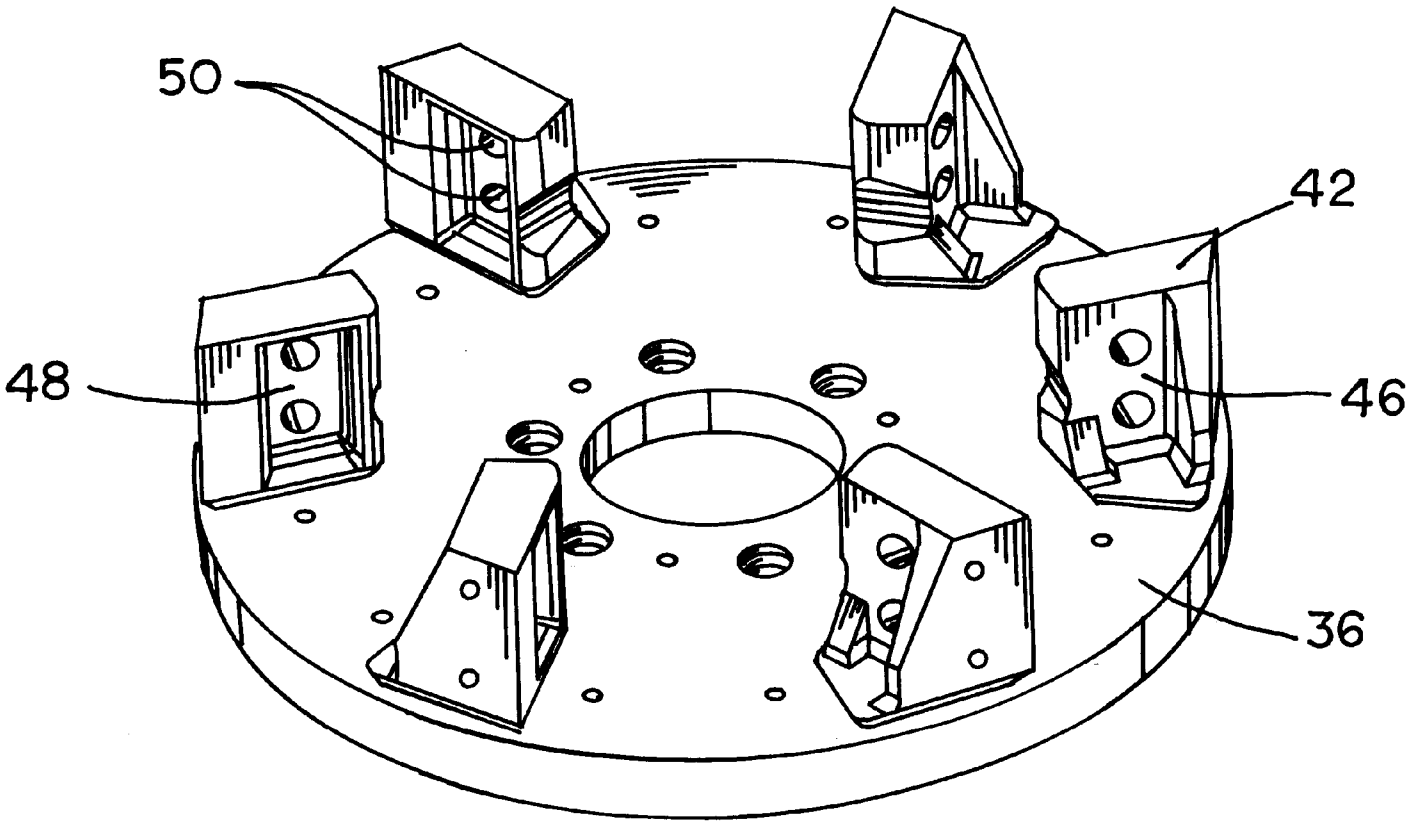
FIG. 5 is a perspective view of a table in accordance with the present invention having a plurality of brackets attached thereto.
Figure 6:
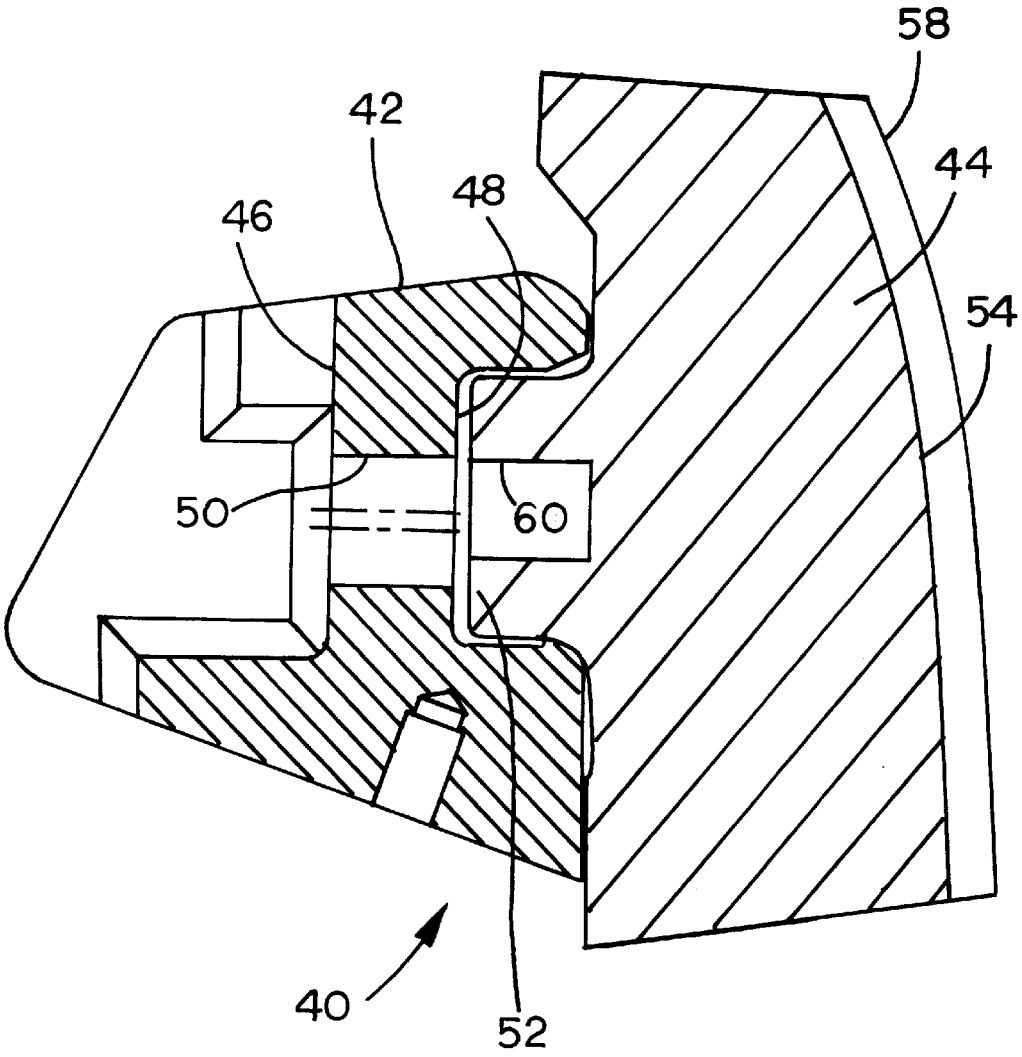
FIG. 6 is a top plan view, in section, of a shoe assembly of the present invention.

At least one shoe assembly 40 is attached to an upper surface of the table assembly 28. As shown in FIGS. 3 and 6, each shoe assembly 40 comprises a bracket 42 and a removable shoe 44. In the currently preferred embodiment, each bracket 42 is welded to the table assembly 28 near a periphery of the table 36 (FIG. 5). Each bracket 42 is formed with a recess 46 located generally in a rear face of the bracket and a pocket 48 located in a front face of the bracket. A pair of bolt holes 50 extend through the bracket 42 from the recess 46 to the pocket 48.

Figure 4:
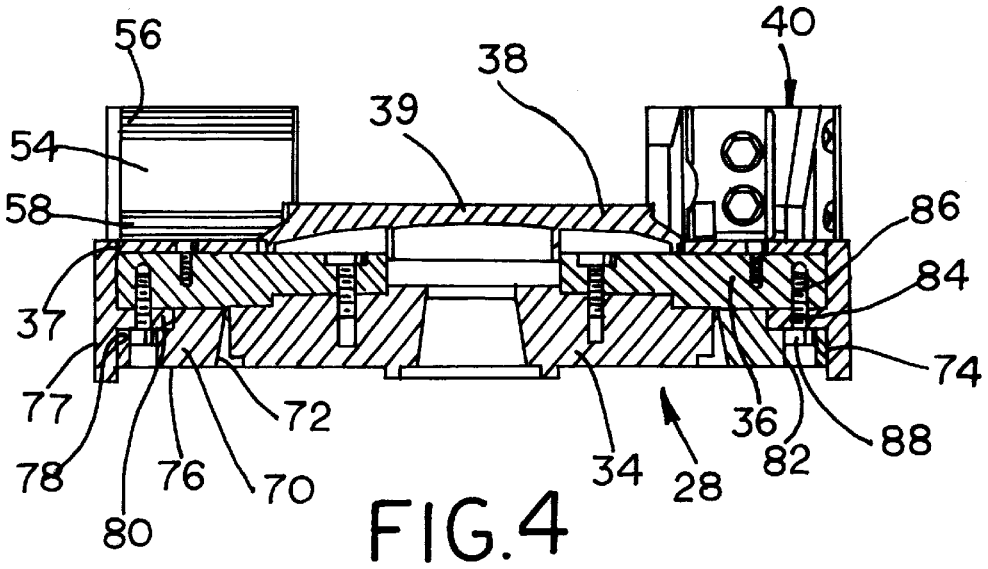
FIG. 4 is a side elevational view, in section, of the table assembly taken along line 4—4 of FIG. 3.

Each shoe 44 is formed to be releasably attached to a corresponding one of the brackets 42. A boss 52 projects from a rear attachment surface of each shoe 44 and is shaped to slidably fit inside the pocket 48 formed in the bracket 42. A pair of threaded holes 60 are formed in the boss 52 and are positioned so that they are aligned with the bolt holes 50 when the boss 52 is inserted in the pocket 48, as illustrated in FIG. 6. A pair of bolts 62 (FIG. 3) are inserted through the bolt holes 50 and into the threaded holes 60 to thereby releasably secure the shoe 44 to the corresponding bracket 42. A front face of the shoe 44 provides a curved guide surface 54 extending generally radially from the central axis 22. The guide surface 54 has forwardly projecting upper and lower edges 56, 58 (FIG. 4).

The illustrated embodiment depicts shoes 44 which are attached to brackets 42 using bolts 62. Other arrangements, such as brackets which allow the use of pins, rather than bolts, to secure the shoes may also be used in accordance with the present invention. It will be understood, however, that the bolt-type shoe assemblies have generally heavier brackets 42 which result in greater bending moments and shear forces applied to the table 36.

An anvil ring 64 is located around a periphery of the housing 12 for providing an impact surface 66 for breaking rock material (FIG. 2). According to the illustrated embodiment, the anvil ring 64 comprises a plurality of individual anvils 65 spaced about the interior of the housing 12. While the illustrated embodiment shows an anvil ring 64, it will be appreciated that the impact surface 66 may be provided by other structure, such as previously broken rock material accumulating on a rock shelf. Crushed rock collects in a bottom portion of the housing 12 where a removal device (not shown) carries the crushed rock out of the crusher 10.

In operation, rock material is dumped into the hopper 16 where it passes through the feed opening 15 to be deposited on the landing surface 39 of the table assembly 28. In the illustrated embodiment, the motor 20 drives the shaft 26 so that the attached table assembly 28 rotates in a counterclockwise direction indicated by arrow 11 in FIG. 3. As a result, rock material deposited on the landing surface 39 is driven radially outwardly from the center of the table assembly 28 by centrifugal force. The guide surfaces 54 of the shoes 44 define travel paths through which the rock material is directed. The guide surfaces 54 direct the rock material toward the anvil ring 64 at an angle which optimizes breakage. The broken rock material collects at the bottom of the housing 12 where it is removed.

In accordance with certain aspects of the present invention, the table assembly 28 further comprises a reinforcing ring 70 attached to a bottom surface of the table 36. In the preferred embodiment, the reinforcing ring 70 is formed as an individual component that is welded to the bottom of the table. It will be appreciated, however, that the reinforcing ring 70 may be attached to the table 36 in a variety of manners. If provided as a separate component, the ring 70 may be attached such as by bolting or riveting instead of welding. In the alternative, the reinforcing ring 70 may be integrally formed with the table 36 such as by casting or machining a single, composite component. As best shown in FIG. 4, the reinforcing ring 70 has an inner wall 72 extending around an outside periphery of the flywheel 34, and an outer wall 74 substantially even with an outer edge 37 of the table 36. A bottom surface 76 of the reinforcing ring 70 is substantially planar with a bottom surface of the flywheel 34. The reinforcing ring 70 is responsive to rotation of the table assembly 28 thereby to counteract the downward bending moment imparted by the shoe assemblies 40. As a result, stresses in the table 36 are reduced.

It will be understood that, due to the impact forces of aggregate material contacting the shoe assemblies 40, each shoe assembly 40 will also impart stresses, including bending stresses, to the table in the following manner. Each shoe assembly 40 will tend to impart a bending moment to the table 36, with the bending moment being applied about a radial axis extending from the center of the table 36 through the corresponding shoe assembly 40. It will be appreciated that the reinforcing ring 70 will further stiffen the table 36, such that any bending about one or more radial axes is minimized.

In accordance with additional aspects of the present invention, the reinforcing ring 70 may be adapted to allow the outer edge 37 of the table 36 to be protected from the crushing impact inside the crusher 10. As best illustrated in FIG. 4, the reinforcing ring 70 is formed to accept a rim liner 77. The outer wall 74 of the reinforcing ring 70 is provided with a shoulder 78. When the ring 70 is attached to the table 36, a notch is formed therebetween. The shoulder 78 has a sufficient vertical height so that the resulting notch accepts an inwardly projecting flange 80 of the rim liner. Bolt holes 82, 84 are formed in the reinforcing ring 70 and flange 80, respectively. Threaded holes 86 are formed in the bottom surface of the table 36 and aligned with the bolt holes 82, 84. Bolts 88 are inserted through the bolt holes 82, 84 and into the threaded holes 86 to secure the liner 77 in place. The bolt holes 82 in the reinforcing ring 70 have a relatively larger diameter so that the heads of the bolts 88 pass through the bolt holes 82. As a result, the bolts 88 secure the flange 80 to the table 36. The liner 77 may be formed in at least two pieces to allow removal and replacement.

The vertical shaft impact crusher of the present invention has significant advantages over prior crushers. By providing a reinforcing ring attached to a bottom surface of the table, the crusher may be operated at higher rotational speeds or with heavier shoe assemblies. The increased bending moment and shear forces are resisted by the reinforcing ring so that the same table thickness and diameter may be used. As a result, existing rock crushers may be retrofitted for different operation parameters without requiring substantial replacement or modification of existing crusher components.

The foregoing detailed description has been given for clearness for understanding only, and no unnecessary limitations should be understood therefrom, as modifications would be obvious to those skilled in the art.

What is claimed is:

1. A table assembly for use in a vertical shaft impact crusher for crushing aggregate material, the crusher including a housing having an interior defining an impact surface, the table assembly comprising:

a flywheel disposed inside the housing and supported for rotation about a vertical axis;

a table adapted for attachment to the flywheel, the table having a top surface, a bottom surface, and a peripheral edge, a portion of the table top surface defining an aggregate material landing surface;

a plurality of shoe assemblies mounted to the top surface of the table adjacent to and circumferentially spaced along the peripheral edge, each of the shoe assemblies having a guide surface positioned to throw the outwardly migrating aggregate material toward the impact surface in response to rotation of the table assembly, the shoe assemblies collectively imparting a downward bending moment to the table assembly in response to rotation of the table assembly;

a liner mounted to the outer periphery of the table; and a reinforcing ring attached to the bottom surface of the table at a point disposed radially outwardly of an outer extent of the flywheel and radially inwardly of an inner extent of the liner, the reinforcing ring being sized to counteract the downward bending moment, thereby relieving stresses on the table assembly.

2. The table assembly of claim 1, wherein the reinforcing ring includes an outer wall formed with an annular shoulder which defines a circumferential notch between the reinforcing ring and the bottom surface of the table, the circumferential notch being sized to accept a flange of the protective liner.

3. The table assembly of claim 1, wherein the reinforcing ring includes a circumferential outer edge portion, the circumferential outer edge portion extending outwardly to the peripheral edge of the table.

4. The table assembly of claim 1, in which the reinforcing ring is integrally formed with the table.

5. A vertical shaft impact crusher for crushing aggregate material, the crusher comprising:

a housing defining an impact surface spaced about an interior of the housing a flywheel disposed inside the housing and supported for rotation about a vertical axis;

a table mounted to the flywheel and having an upper portion, a lower portion, and a peripheral edge portion;

a portion of the table upper portion being adapted to receive the aggregate material and permit outward migration of the aggregate material in response to a centrifugal force generated as the table rotates;

a plurality of impact shoes mounted to the upper portion of the table and being spaced outwardly from the central portion, each impact shoe being adapted to contact a portion of the outwardly migrating aggregate material to thereby throw the portion of aggregate material against the impact surface of the housing in response to rotation of the table, the plurality of impact shoes collectively imparting bending stresses to the table in response to the aggregate material contacting the shoes as the table rotates; and a reinforcing ring mounted to the table lower portion at a point disposed radially outwardly of an outer extent of the flywheel, the reinforcing ring being sized to counteract the bending stresses in the table.

6. The vertical shaft impact crusher of claim 5, further comprising a protective liner mounted to the peripheral edge portion of the table, and in which the point at which the reinforcing ring is mounted to the table is also disposed radially inwardly of an inner extent of the protective liner.

7. The vertical shaft impact crusher of claim 6, in which the reinforcing ring includes an outer wall formed with an annular shoulder which defines a circumferential notch between the reinforcing ring and the bottom surface of the table, the circumferential notch being sized to accept an inwardly extending flange of the protective liner.

8. The vertical shaft impact crusher of claim 5, wherein the reinforcing ring includes a cylindrical wall which extends outwardly to the peripheral edge portion of the table.

9. The vertical shaft impact crusher of claim 5, in which the reinforcing ring is integrally formed with the table.

10. In a vertical shaft impact crusher for throwing rock material against an impact surface a table assembly comprising a table supported for rotation about an axis and having an top surface and a bottom surface, the table top surface including a a portion defining a land surface for the rock material, a plurality of shoe assemblies attached to the top surface of the table, each of the shoe assemblies positioned to throw the rock material toward the impact surface, and the bottom surface of the table including a downwardly projecting portion defining a reinforcing ring.

11. The table assembly of claim 10, further comprising a flywheel attached to a center portion of the bottom surface of the table, and the reinforcing ring is attached at a point disposed radially outwardly of an outer extent of the flywheel.

12. The table assembly of claim 10, wherein each shoe assembly comprises a bracket attached to a top surface of the table and an associated shoe releasably attached to the bracket.

13. The table assembly of claim 12, wherein each bracket has a bolt hole and each associated shoe has a corresponding threaded hole, the table assembly further comprising a bolt inserted through the bolt hole and screwed into the threaded hole, thereby to releasably secure the shoe the bracket.

14. The table assembly of claim 10, wherein the reinforcing ring has an outer wall substantially even with an outer periphery of the table.

15. The table assembly of claim 14, further comprising a rim liner having a cylindrical side wall extending about the outer periphery of the table, the side wall extending vertically from the top surface of the table to a bottom surface of the reinforcing ring, the rim liner further comprising a flange for releasably attaching the rim liner to the table.

16. The table assembly of claim 15, wherein an annular shoulder is formed in the outer wall of the reinforcing ring to thereby define a notch between the reinforcing ring and the table, and the flange of the rim liner is inserted into the notch.

17. The table assembly of claim 15, wherein the rim liner is formed in at least two pieces.

18. A vertical shaft impact crusher comprising:

a rotatable flywheel;

a table mounted to the flywheel and adapted to receive thereon a plurality of shoe assemblies;

a liner mounted to the outer periphery of the table; and a reinforcing ring, the reinforcing ring being adapted for attachment to a lower portion of the table at a point disposed radially outwardly of an outer extent of the flywheel and radially inwardly of an inner extent of the liner, whereby the reinforcing ring stiffens the table against bending moments in the table generated during operation of the vertical shaft impact crusher.

19. The vertical shaft impact crusher of claim 18, in which each shoe assembly comprises a bracket attached to an upper portion of the table and a shoe releasably attached to the bracket.

20. The vertical shaft impact crusher of claim 19, in which the bracket of each shoe assembly includes a hole, each shoe has a corresponding threaded hole, and a bolt is inserted through each bolt hole and screwed into each corresponding threaded hole to releasably secure the shoe to the bracket.

21. The vertical shaft impact crusher of claim 18, in which the reinforcing ring has an outer wall substantially even with an outer periphery of the table.

22. The vertical shaft impact crusher of claim 21, in which the liner comprises a cylindrical side wall extending about the outer periphery of the table, the side wall extending vertically from a top surface of the table to a bottom surface of the reinforcing ring, and a flange extending radially inwardly from the outer wall for securing the liner to the bottom surface of the table.

23. The vertical shaft impact crusher of claim 22, in which the outer wall of the reinforcing ring is formed with a shoulder which defines a notch between the reinforcing ring and the table, and the flange of the liner is inserted into the notch.

24. The vertical shaft impact crusher of claim 22, in which the liner is formed in at least two pieces.

* * * * *